United States Patent [19]

Cobb et al.

[11] Patent Number: 4,771,496

[45] Date of Patent: Sep. 20, 1988

[54] BUNDLING BEDDING

[76] Inventors: Don R. Cobb, 1807 Long Pointe Dr., Bloomfield Hills, Mich. 48013; Anne J. Casey, 212 Westchester, Birmingham, Mich. 48009

[21] Appl. No.: 107,672

[22] Filed: Oct. 13, 1987

[51] Int. Cl.[4] ..... A47G 9/00; A47G 9/02

[52] U.S. Cl. ..... 5/485; 5/494; 5/502

[58] Field of Search ..... 5/482, 485, 486, 494, 5/497, 500, 502, 495, 496, 499

[56] References Cited

U.S. PATENT DOCUMENTS

| | | | |
|---|---|---|---|
| 1,639,156 | 8/1927 | Wilmert . | |
| 1,964,271 | 6/1934 | O'Dwyer . | |
| 2,177,679 | 10/1939 | Weisbender | 5/485 |
| 3,254,348 | 6/1966 | Di Addario | 5/497 X |
| 3,331,088 | 7/1967 | Marquette . | |
| 3,508,285 | 4/1970 | Marquette . | |
| 3,795,019 | 3/1974 | Fragas . | |
| 4,069,526 | 1/1978 | Deikel | 5/486 |
| 4,402,098 | 9/1983 | McClam | 5/499 X |

*Primary Examiner*—Michael F. Trettel

*Attorney, Agent, or Firm*—Lawrence J. Shurupoff

[57] ABSTRACT

A bed covering includes a flat top sheet interconnected to a fitted bottom sheet along a central longitudinal connecting and reinforcing region. In this manner two separate sleeping compartments are defined which allocate bed space, prevent loss of bed coverings during sleep and limit contact between adjacent sleepers.

10 Claims, 1 Drawing Sheet

BUNDLING BEDDING

BACKGROUND OF THE INVENTION

1. Field of the Invention

This invention relates generally to bed coverings and particularly concerns an interconnected top and bottom sheet assembly which defines separate sleeping areas.

2. Description of Prior Developments

Various bed and mattress covering arrangements have been designed to accommodate the sleeping preferences of two individuals sharing the same bed. For example, U.S. Pat. Nos. 3,331,088 and 3,508,285 disclose blankets formed of detachable half panels which may be individually added or removed to suit the warmth requirements of each occupant of the bed. Another bed covering disclosed in U.S. Pat. No. 3,795,019 provides for two separately elevatable covering sections adjacent the head end of a bed for use with a mattress having two separately elevatable halves at its head end. This enables two users of the bed to adjust their halves of the bed without bothering one another. While these bed coverings adequately serve their intended functions, a need still exists for a bed covering of simple, economical design which maintains the privacy of each person sharing the same bed yet allows the occupants freedom of movement.

Situations arise where available bed space is limited, particularly in a large family where brothers and sisters share the same bed. In this case it is desirable to equally allocate the bed space while avoiding direct contact between the siblings. Moreover, the feeling of closeness experienced by certain persons sharing a bed can be uncomfortable or annoying and can result in tension and stress.

Another problem often experienced by individuals sharing a bed is the loss of bed coverings as one or both sleepers unintentionally kick or throw the sheets and covers from the bed during the night. A related difficulty exists when one sleeper intentionally removes the bedding to sleep unencumbered or to reduce the warmth of the bedding to the dislike of the other sleeper.

Still another sleeping problem arises when sleeping facilities are limited such as in a college dormitory or apartment. Students commonly share quarters with friends and "friends of friends" of the same or opposite sex. In these situations someone often finds themself sleeping on the floor even though bed space is available, although partially occupied.

Another sleeping problem of current concern relates to the health risks associated with touching and sexual activity. Couples may wish to sleep together but prefer to limit or avoi touching and/or sexual activity.

Accordingly, a need exists for a bed covering of simple construction which equally allocates bed space, prevents cover removal by kicking, tossing or other means, allows one sleeper to sleep without bedding while the adjacent sleeper is covered, and effectively separates occupants of the bed so as to avoid direct physical contact, while preserving freedom of movement.

SUMMARY OF THE INVENTION

The present invention has been designed to satisfy the needs identified above and therefore has as an object the provision of an economical and simply constructed bed covering formed of a minimum of parts and which allocates bed space, resists removal, and separates sleepers from direct physical contact at predetermined areas, while preserving freedom of movement. These objects are achieved with a bed covering assembly formed of a top sheet or covering which is preferably permanently secured to a bottom sheet or covering along a central longitudinal region extending from the sleeper's shoulder or chest area to the sleeper's ankle area.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENTS

Figure 1:
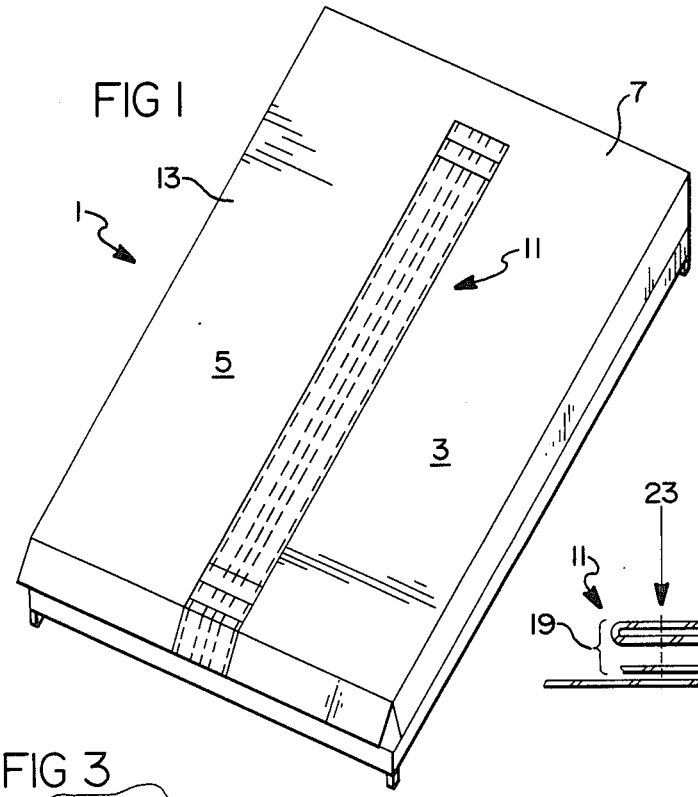
FIG. 1 is a perspective view of the bundling bedding fitted over a double bed.
Figure 2:
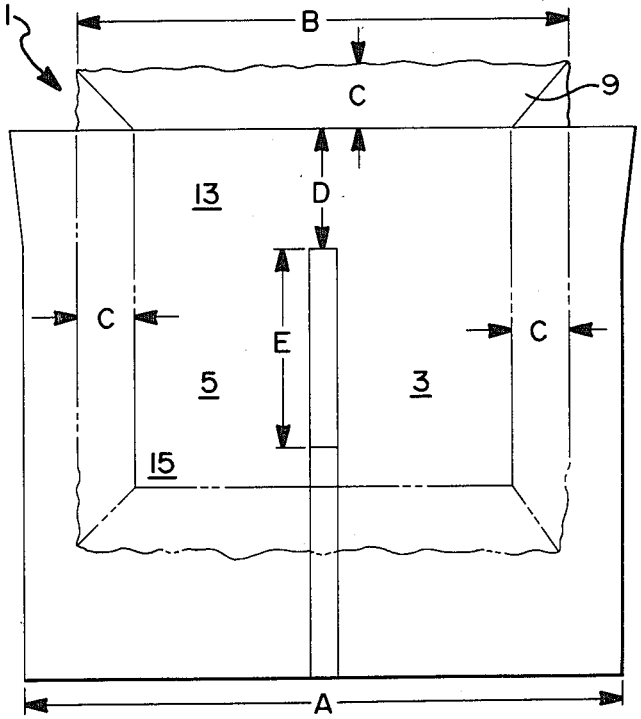
FIG. 2 is a top plan view of the bundling bedding showing the bottom cover partially in phantom.

The present invention will now be described in conjunction with the drawings beginning with FIGS. 1 and 2 which show a bed covering construction (1) which defines at least two individual separated sleeping areas or compartments (3, 5). The term bed covering is intended to include sheets, bed spreads, blankets, comforters, quilts or any other type of covering used for warmth on any size or type of mattress or bed.

A top cover (7), preferably a double, queen or king size flat sheet, is attached to and extends over the full width of a bottom cover (9), preferably a matching double, queen or king size fitted sheet. The attachment zone extends along a longitudinally disposed connecting and reinforcing section (11) which separates the sleeping areas and provides privacy to each sleeper. Preferably, both the top and bottom cover are of a one-piece construction and formed with uniform thicknesses. The bed covering assembled in this manner reduces the disturbance caused to one sleeper by an adjacent sleeper's movement.

Since the bottom fitted sheet is securely anchored to a mattress or the like in a conventional manner as with elastic borders, and since the top flat sheet is securely fixed to the bottom sheet, tugging, pulling, turning, jerking or kicking movements of one sleeper will not dislodge the other sleeper's bed coverings. Moreover, one sleeper's movements while entering or exiting the bed will not disturb the other sleeper's bed covering on the adjacent compartment.

The connecting and reinforcing section (11) preferably extends from a sleeper's arm and shoulder region (13) to the sleeper's ankle and foot region (15). This arrangement prevents direct physical contact between corresponding body portions of adjacent sleepers at predetermined areas, while preserving freedom of movement thorughout each compartment, particularly at the head and foot regions.

Figure 4:
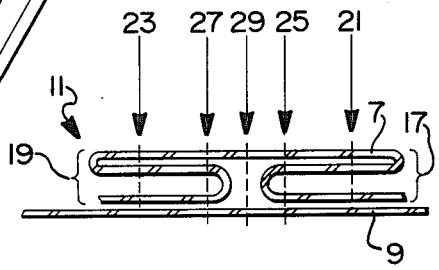
FIG. 4 is a sectional view taken along lines IV - IV of FIG. 3.
Figure 3:
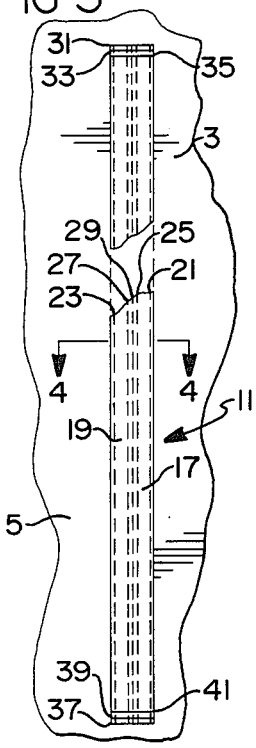
FIG. 3 is a top plan fragmental view of a preferred embodiment the connecting and reinforcing section.

The details of the connecting and reinforcing section are depicted in FIGS. 3 and 4 wherein the top cover is shown attached to the bottom cover in a multi-layered construction. More particularly, the central portion of the top cover is folded over itself to form two parallel longitudinally extending three-layered pleats (17, 19). These pleats provide the necessary strength to resist tearing and stop all pulling and tugging of the bed covering. Thus, all movement of the bed covering is contained within each individual's separate sleeping area.

The top cover is securely fastened to the bottom cover through or along each layered pleat, preferably in a permanent manner by stitching. Although stitching is preferred, other types of fasteners may be used including Velcro type hook and load fasteners, zippers, staples, buttons, hooks, pins, clips, lacing, ties and the like. It is preferable, although not required, to align the top cover over the bottom cover as shown in FIG. 2 to form two compartments of equal area to equally allocate bed space to each occupant. However, it is possible to form compartments of unequal area to suit large and small sleepers sharing the same bed or to form three or more compartments by adding additional connecting and reinforcing sections spaced apart so as to define as many compartments as required.

As further seen in FIGS. 3 and 4, a pair of outer seams (21, 23) is stitched through the outer edges of the pleats (17, 19,) while a pair of inner seams (25, 27) is stitched along the inner portions of the pleats and through the bottom cover. A central seam (29) is stitched through each cover along the center of the connecting and reinforcing section for added strength. Seams 25 and 27 extend through four layers of the bedding, seams 21 and 23 extend through three layers of the bedding while seam 29 extends through two layers of the bedding. This arrangement not only provides a secure connection between the top and bottom sheet but also provides for quick and easy folding of the bedding along seam (29) for storage purposes.

To complete the attachment of the top sheet to the bottom sheet, three transverse seams (31, 33, 35) are stitched across the upper longitudinal end of the connecting and reinforcing section and three transverse seams (37, 39, 41) are stitched across the lower longitudinal end of the connecting and reinforcing section. By using standard fitted and flat sheets, a most economical and convenient covering may be constructed using a minimum of parts and inventory. Moreover, by permanently stitching a continuous unitary flat top sheet to a continuous unitary bottom fitted sheet, a simple construction results which requires no assembly by a user and which prevents loss of parts during washing and facilitates bed making.

A specific example of the construction of the invention using a flat top sheet and a fitted bottom sheet having conventional top and bottom elastic borders will aid in appreciating the simple yet effective design of the bundling bedding. As seen in FIG. 2, a full size top sheet (7) having a final width (A) of 90 inches is attached to a fitted bottom sheet (9) having a total width (B) of 70 inches so as to form symmetrical compartments (3, 5) therebetween. The length of the top sheet is nominally 102 inches while that of the bottom sheet is 92 inches. About 8.5 inches of the bottom sheet covers the sides of the mattress in a conventional manner as shown at (C). The connecting and reinforcing section begins at distance (D) of 17 inches below the top edge of the top sheet and extends toward the bottom of the bedding over a distance (E) of 52 inches.

As seen in FIGS. 3 and 4, seams (21) and (23) are each located about $\frac{1}{8}$ inch from the outer edges of pleats (17) and (19) while seams (25) and (27) are each spaced about $\frac{1}{4}$ inch from the center seam (29). The width of the connecting and reinforcing section is about 2 inches, with pleats (17) and (19) each about 1 inch wide. Seams (31) through (35) are spaced about $\frac{1}{4}$ inch apart as are seams (37) through (41).

Obviously, numerous modifications and variations of the present invention are possible in light of the above teachings. It is therefore to be understood that within the scope of the appended claims, the invention may be practiced otherwise than as specifically described herein. For example seams (21) and (23) may continue to extend to the bottom edge of the top sheet for aesthetic purposes. Moreover, the width of the connecting and reinforcing section may be varied to provide a custom fit for particular applications by taking in or letting out various lengths of fabric thereby varying the width of the pleats.

What is claimed is:

1. A bed covering, comprising:

a continuous one-piece top flat sheet having an interior portion;

a continuous one-piece bottom sheet having an interior portion; and a longitudinal extending connecting and reinforcing section permanently interconnecting said interior portions of said top and bottom sheets so as to permanently form a first sleeping compartment and a second sleeping compartment, said first and second sleeping compartments being permanently separated by said connecting and reinforcing section.

2. The bed covering of claim 1 wherein said bottom sheet comprises a fitted sheet.

3. The bed covering of claim 1 wherein said top sheet extends over the entire width of said bottom sheet.

4. The bed covering of claim 1 wherein said connecting and reinforcing section is interconnected to a central portion of said top sheet and a central portion of said bottom sheet to form said sleeping compartments with approximately equal sleeping areas.

5. The bed oovering of claim 1 wherein said top sheet comprises a pair of stitched pleats.

6. The bed covering of claim 5 wherein each of said pair of stitched pleats is stitched to said bottom sheet.

7. The bed covering of claim 1 wherein said connecting and reinforcing portion comprises longitudinal end portions and wherein each longitudinal end portion of said connecting and reinforcing section is provided with a transversely stitched seam.

8. The bed covering of claim 1 wherein said connecting and reinforcing section extends over a length of about 52 inches to prevent direct physical contact between adjacent sleepers from about the sleeper's chest region to about the sleepers' ankle regions.

9. The bed covering of claim 1, wherein said top sheet is formed with a uniform thickness.

10. A bed covering, comprising:

a continuous one-piece top flat sheet having a central pleated portion;

a bottom sheet; and a connecting and reinforcing section comprising a plurality of longitudinally stitched seams formed through said pleated portion and through a central portion of said bottom sheet so as to permanently interconnect said top and bottom sheets, said connecting and reinforcing section forming two separate sleeping compartments with approximately equal sleeping areas between said top and bottom sheets, said compartments being located on opposite sides of said connecting and reinforcing section.

* * * * *